US005488354A

United States Patent [19]

Colvin

[11] Patent Number: 5,488,354

[45] Date of Patent: Jan. 30, 1996

[54] SNOOZE ALERT DEVICE

[76] Inventor: Bobby R. Colvin, 308 23rd St. North, Columbus, Miss. 39701

[21] Appl. No.: 349,017

[22] Filed: Dec. 2, 1994

[51] Int. Cl.[6] ..... G08B 21/00

[52] U.S. Cl. ..... 340/576; 340/575

[58] Field of Search ..... 340/576, 575

[56] References Cited

U.S. PATENT DOCUMENTS 4,177,460 12/1979 Hoinski et al. ..... 340/575

FOREIGN PATENT DOCUMENTS 1329658 9/1973 United Kingdom ..... 340/575

*Primary Examiner*—Glen Swann
*Attorney, Agent, or Firm*—Michael I. Kroll

[57] ABSTRACT

A snooze alert device comprises a flexible collar to be worn about a neck of a person. A portable power source is carried in the flexible collar. An audible alarm unit is carried in the flexible collar. A plurality of alarm actuating switches are disposed about the periphery of the collar. Each alarm actuating switch is electrically connected between the portable power source and the audible alarm unit. If the person trys to fall asleep and tilts the neck, the flexible collar will collapse and one said alarm actuating switch will close, causing the audible alarm unit to sound off and wake up the person.

9 Claims, 2 Drawing Sheets

SNOOZE ALERT DEVICE

BACKGROUND OF THE INVENTION

1. Field of the Invention

The instant invention is the subject matter of Disclosure Document No.: 362335, filed in the PTO on Sep. 27, 1994, and it is respectfully requested that this document be retained beyond the two-year period so that it may be relied upon as evidence of conception of the invention during the prosecution phase of this application, should the need arise.

The instant invention relates generally to alarm systems and more specifically it relates to a snooze alert device.

2. Description of the Prior Art

Numerous alarm systems have been provided in prior art that are adapted to signal the existence of abnormal conditions by the use of audible or visible discrete changes, or both, intended to attract attention. While these units may be suitable for the particular purpose to which they address, they would not be as suitable for the purposes of the present invention as heretofore described.

SUMMARY OF THE INVENTION

A primary object of the present invention is to provide a snooze alert device that will overcome the shortcomings of the prior art devices.

Another object is to provide a snooze alert device that is so constructed to prevent a person wearing the device about a neck from falling asleep at inopportune times.

An additional object is to provide a snooze alert device that is a flexible collar worn about the neck of the person with a portable power source and a plurality of alarm actuating switches, which will sound an audible alarm unit when the neck of the person is tilted at any angle, causing the person starting to fall asleep to wake up.

A further object is to provide a snooze alert device that is simple and easy to use.

A still further object is to provide a snooze alert device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
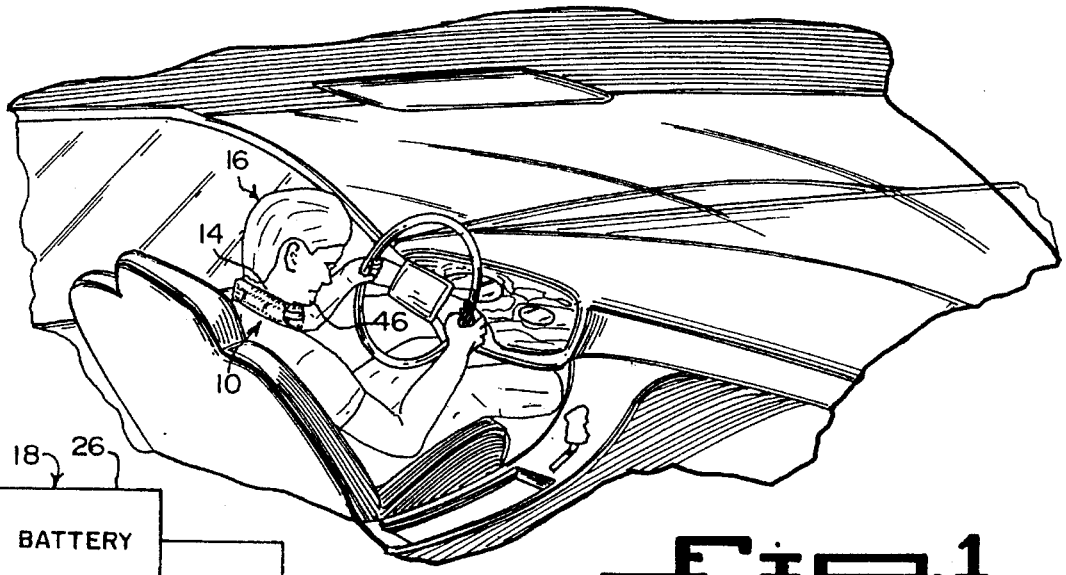
FIG. 1 is a perspective view of a portion of a motor vehicle, showing a person being the driver wearing and using the instant invention.
Figure 8:
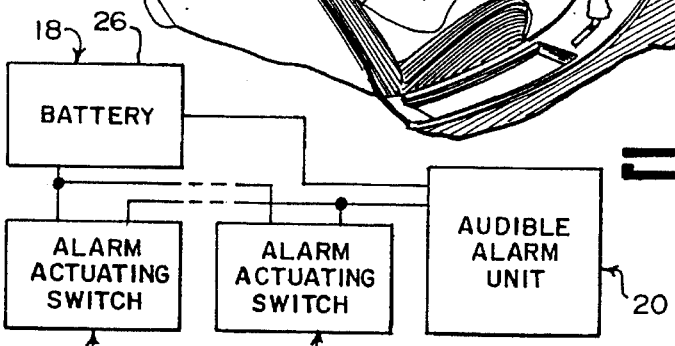
FIG. 8 is a block diagram of the electric circuit of the instant invention.
Figure 3:
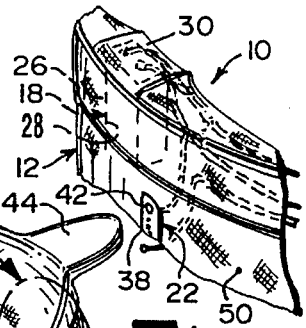
FIG. 3 is a perspective view of a portion of the collar as indicated by arrow 3 in FIG. 2, with the battery placed back in the holder.

Turning now descriptively to the drawings, in which similar reference characters denote similar elements throughout the several views, FIGS. 1 through 7 illustrate a snooze alert device 10 comprising a flexible collar 12 to be worn about a neck 14 of a person 16. A portable power source 18 is carried in the flexible collar 12. an audible alarm unit 20 is carried in the flexible collar 12. A plurality of alarm actuating switches 22 are disposed about the periphery of the collar 12. Each alarm actuating switch 22 is electrically connected between the portable power source 18 and the audible alarm unit 20. If the person 16 trys to fall asleep and tilts the neck 14, the flexible collar 12 will collapse and one alarm actuating switch 22 will close, causing the audible alarm unit 20 to sound off and wake up the person 16.

The flexible collar 12 includes a pair of adjustable connector straps 24, so that the flexible collar 14 can properly fit about different sized necks 14. The portable power source 18 is a battery 26.

The flexible collar 12 contains a holder pocket 28 to retain the battery 26 therein. A flap 30 is over the holder pocket 28 to seal the battery 26 within the holder pocket 28.

Figure 7:
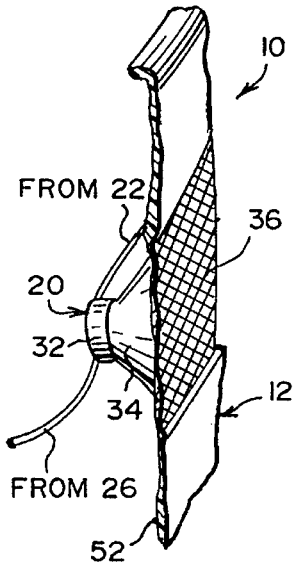
FIG. 7 is a perspective view of a portion of the collar as indicated by arrow 7 in FIG. 2, showing the audible alarm unit in greater detail.

The audible alarm unit 20, as shown in FIG. 7, consists of an alarm circuit 32 electrically connected between each alarm actuating switch 22 and the battery 26. A speaker 34 is coupled to the alarm circuit 32. A grille 36 is in the flexible collar 12 in front of the speaker 34.

Each alarm actuating switch 22 includes a bendable plastic strip 38 vertically mounted to an exterior surface of the flexible collar 12. the bendable plastic strip 38 has a plurality of longitudinal spaced apart holes 40. A pair of adjustable contacts 42 are provided. Each contact 42 is insertable into one hole 40, to engage and disengage with each other when the bendable plastic strap 38 is bent over by the tilting of the neck 14 of the person 16.

The flexible collar 12 further contains a stiff stem 44 extending horizontally from a top edge thereof. When the flexible collar 12 is worn on the neck 14 of the person 16, the stiff stem 44 will be directly under the chin 46 of the person 16. The chin 46 will press the stiff stem 44 downwardly when the neck 14 of the person 16 tilts forward, causing the flexible collar 12 to collapse under the stiff stem 44.

Figure 2:
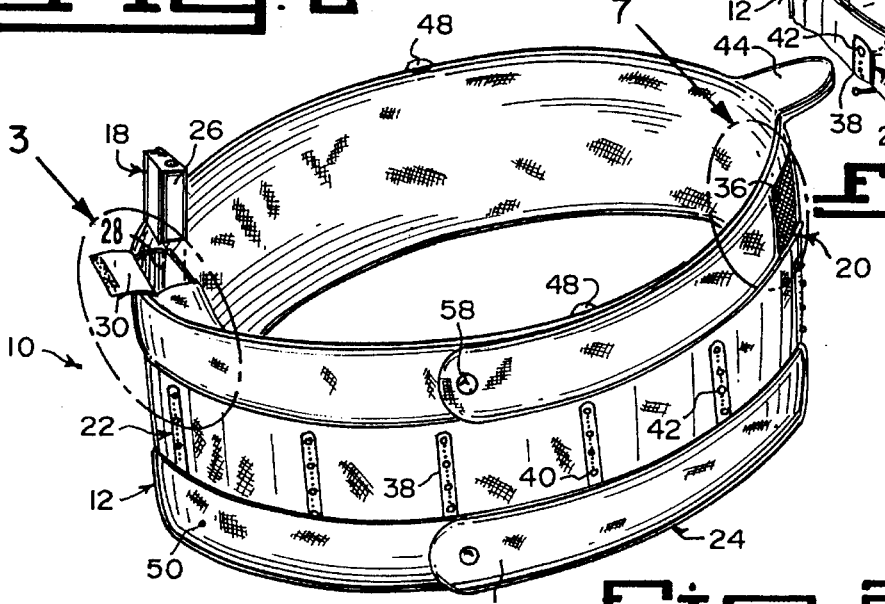
FIG. 2 is a perspective view of the instant invention with the battery being removed from the holder and the snap connector straps closed.

The flexible collar 12 can further include a plurality of bumpers 48 mounted about said top edge thereof, as shown in FIG. 2. When the neck 14 of the person 16 tilts backward and to either side, the neck 14 will press one of the bumpers 48 downwardly, causing the flexible collar 12 to collapse under the respective bumper 48.

The flexible collar 12 can also be fabricated out of a soft plastic material 52. Other pliable materials such as rubber, paper and the like can also be utilized for the flexible collar 12.

Figure 4:
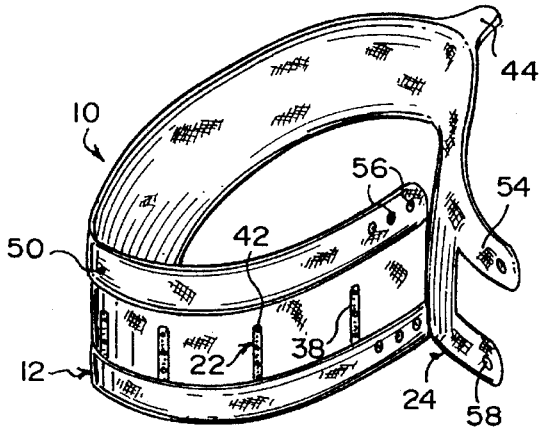
FIG. 4 is a perspective view of the instant invention with the snap connector straps opened.

Each adjustable connector strap 24, as shown in FIGS. 2 and 4, can be a snap fastener type 54 which includes a plurality of stud members 56 mounted along the flexible collar 12. A socket member 58 is mounted in a distal end of the strap 24, to engage with any one of the stud members 56.

Figure 5:
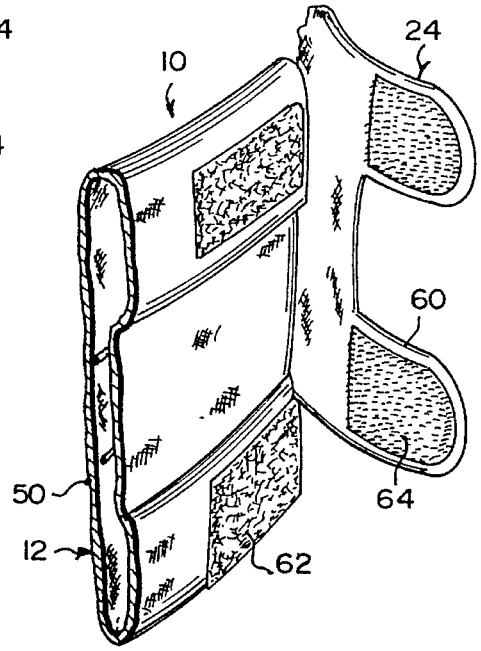
FIG. 5 is a perspective view of a portion of the collar with the VELCRO connector straps opened.
Figure 6:
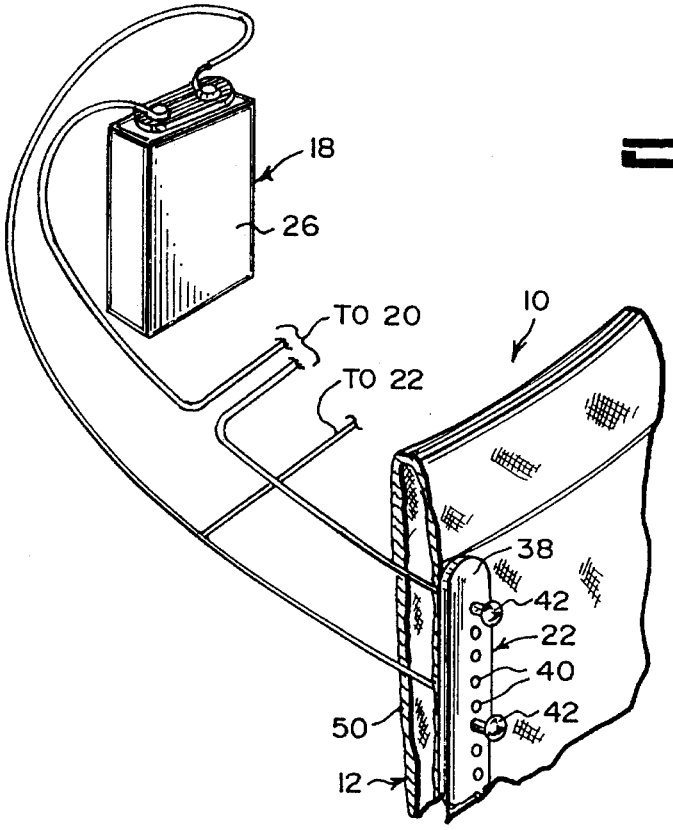
FIG. 6 is a perspective view of a portion of the collar showing the electrical hook up between the battery and one of the alarm actuating switches.

Each adjustable connector strap 24, as shown in FIG. 5, can also be a VELCRO fastener type 60, which consists of a first VELCRO tab 62 mounted on the flexible collar 12. A second VELCRO tab 64 is mounted on a distal end of the strap 24 to engage with the first VELCRO tap 62.

LIST OF REFERENCE NUMBERS

10 snooze alert device
12 flexible collar
14 neck of 16
16 person
18 portable power source in 12
20 audible alarm unit in 12
22 alarm actuating switch in 12
24 adjustable connector strap in 12
26 battery for 18
28 holder pocket in 12 for 26
30 flap over 28
32 alarm circuit of 20
34 speaker of 20
36 grille of 20
38 bendable plastic strip of 22
40 hole in 38
42 contact of 22
44 stiff stem of 22
46 chin of 16
48 bumper of 22
50 cloth material for 12
52 plastic material for 12
54 snap fastener type of 24
56 stud member of 54 on 12
58 socket member of 54 on 24
60 VELCRO fastener type for 24
62 first VELCRO tab on 12
64 second VELCRO tab on 24

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A snooze alert device comprising:

a) a flexible collar to be worn about a neck of a person, said flexible collar including a pair of adjustable connector straps, so that said flexible collar can properly fit about different sized necks;

b) a portable power source carried in said flexible collar, said portable power source being a battery;

c) an audible alarm unit carried in said flexible collar;

d) a plurality of alarm actuating switches disposed about the periphery of said collar, each said alarm actuating switch electrically connected between said portable power source and said audible alarm unit, so that if the person tries to fall asleep and tilts the neck, said flexible collar will collapse and one said alarm actuating switch will close, causing said audible alarm unit to sound off and wake up the person;

e) a holder pocket to retain said battery therein; and f) a flap over said holder pocket to seal said battery within said holder pocket.

2. A snooze alert device as recited in claim 1, wherein said audible alarm unit includes:

a) an alarm circuit electrically connected between each said alarm actuating switch and said battery;

b) a speaker coupled to said alarm circuit; and c) a grille in said flexible collar in front of said speaker.

3. A snooze alert device as recited in claim 2, wherein each said alarm actuating switch includes:

a) a bendable plastic strip vertically mounted to an exterior surface of said flexible collar, said bendable plastic strip having a plurality of longitudinal spaced apart holes; and b) a pair of adjustable contacts, with each said contact insertable into one said hole to engage with each other when said bendable plastic strap is bent over by the tilting of the neck of the person.

4. A snooze alert device as recited in claim 3, wherein said flexible collar further includes a stiff stem extending horizontally from a top edge thereof, so that when said flexible collar is worn on the neck of the person said stiff stem will be directly under the chin of the person in which the chin will press said stiff stem downwardly when the neck of the person tilts forward, causing said flexible collar to collapse under said stiff stem.

5. A snooze alert device as recited in claim 4, wherein said flexible collar further includes a plurality of bumpers mounted about said top edge thereof, so that when the neck of the person tilts backward and to either side the neck will press one of said bumpers downwardly, causing said flexible collar to collapse under said respective bumper.

6. A snooze alert device as recited in claim 5, wherein said flexible collar is fabricated out of a cloth material.

7. A snooze alert device as recited in claim 5, wherein said flexible collar is fabricated out of a soft plastic material.

8. A snooze alert device as recited in claim 5, wherein each said adjustable connector strap is a snap fastener type which includes:

a) a plurality of stud members mounted along said flexible collar; and b) a socket member mounted in a distal end of said strap to engage with any one of said stud members.

9. A snooze alert device as recited in claim 5, wherein each said adjustable connector strap is a VELCRO fastener type which includes:

a) a first VELCRO tab mounted on said flexible collar; and b) a second VELCRO tab mounted on a distal end of said strap to engage with said first VELCRO tab.

* * * * *